United States Patent [19]

Joseph

[11] Patent Number: 4,956,675

[45] Date of Patent: Sep. 11, 1990

[54] RIBBON BLENDER FOR A DEVELOPMENT APPARATUS WITH SELF ADJUSTING INNER AND OUTER RIBBONS

[75] Inventor: Brian J. Joseph, Rochester, N.Y.

[73] Assignee: Eastman Kodak Company, Rochester, N.Y.

[21] Appl. No.: 289,147

[22] Filed: Dec. 23, 1988

[51] Int. Cl.[5] ..... G03G 15/09

[52] U.S. Cl. ..... 355/251; 118/657; 366/296; 366/320

[58] Field of Search ..... 355/245, 246, 260, 253, 355/251; 118/653, 656, 657; 366/320, 321, 296; 222/412, DIG. 1

[56] References Cited

U.S. PATENT DOCUMENTS

| | | | |
|---|---|---|---|
| 3,219,178 | 11/1965 | Mayrath . | |
| 3,637,069 | 1/1972 | Christian, deceased et al. | 198/213 |
| 3,802,551 | 4/1974 | Somers | 198/213 |
| 4,610,068 | 9/1986 | Schultz | 366/320 X |
| 4,634,286 | 1/1987 | Pike | 118/657 X |
| 4,671,207 | 6/1987 | Hilbert | 118/657 |
| 4,690,096 | 9/1987 | Hacknauer et al. | 118/657 |
| 4,699,495 | 10/1987 | Hilbert | 355/253 |
| 4,707,107 | 11/1987 | Joseph | 355/253 |
| 4,716,437 | 12/1987 | MacLellan | 222/DIG. 1 X |
| 4,748,471 | 5/1988 | Adkins | 355/253 |
| 4,825,244 | 4/1989 | Hediger | 118/653 |

FOREIGN PATENT DOCUMENTS

| | | | |
|---|---|---|---|
| 0160830 | 11/1985 | European Pat. Off. | 355/251 |
| 0602428 | 4/1978 | U.S.S.R. . | |

*Primary Examiner*—Fred L. Baun
*Assistant Examiner*—William J. Royer
*Attorney, Agent, or Firm*—Milton S. Sales

[57] ABSTRACT

Magnetic brush development apparatus wherein flow of developer material, distributed in balance across the length of the apparatus, is assured. The apparatus includes a sump containing a supply of developer material. A magnetic brush is spaced from the sump. A feed mechanism, located within the housing between the sump portion and the magnetic brush transports developer material from the sump to the magnetic brush. A ribbon blender, located in the sump, agitates and transports developer material to the feed mechanism. The pitch of the blender blades self adjust as a function of developer imbalance. As material builds up, the blades's pitch angles decrease, reducing the rate of material transport toward areas of maximum build up. Thus, for a blender where the desired flow pattern is end-to-end, the end of the other ribbon near the end of the station toward which material is transported by the outer ribbin is self adjusting. Similarly, the portion of the inner ribbon near the end of the station toward which material is transported by the inner ribbon is self adjusting. The end result is a mixing device that self balances.

7 Claims, 2 Drawing Sheets

RIBBON BLENDER FOR A DEVELOPMENT APPARATUS WITH SELF ADJUSTING INNER AND OUTER RIBBONS

CROSS-REFERENCE TO RELATED APPLICATIONS

Reference is made to copending, commonly assigned U.S. patent application Ser. No. 597,323, filed Apr. 6, 1984 in the names of Joseph et al, now U.S. Pat. No. 4,887,132, issued on Dec. 12, 1989.

Technical Field

This invention relates generally to development apparatus for applying developer material to a latent image in an electrostatographic reproduction apparatus, and more particularly to an improved developer material mixing apparatus for assuring substantially balanced developer material flow distribution in such apparatus.

BACKGROUND ART

Magnetic brush development apparatus for applying developer material to a latent image in an electrostatographic reproduction apparatus are well known in the art. Such apparatus may include a housing having a sump portion which contains a supply of developer material. When the developer material comprises a mixture of carrier particles and smaller pigmented marking particles, the material in the sump is agitated to triboelectrically charge the material prior to delivering it to a magnetic brush where it can be brought into association with, and electrostatically transferred to, an electrostatic latent image to develop such image.

Copending, commonly assigned U.S. patent application Ser. No. 597,3Z3, filed Apr. 6, 1984, now U.S. Pat. No. 4,887,132, issued on Dec. 12, 1989 in the names of Joseph et al, now U.S. Pat. No. 4,887,132, issued on Dec. 12, 1989 and U.S. Pat. No. 4,671,207, issued June 9, 1987, in the name of Hilbert disclose magnetic brush development apparatus particularly suitable for use with developer material having pigmented marking particles and permanent magnetic carrier particles, such as disclosed in U.S. Pat. No. 4,546,060, issued Oct. 8, 1985, in the names of Miskinis et al. More particularly, the disclosed apparatus include a ribbon blender that is used for agitating (mixing), feeding and triboelectrically charging such material in the sump portion of a magnetic brush development apparatus, and a feed mechanism that delivers material from the sump portion to a magnetic brush. The ribbon blender is constructed to provide uniform flow distribution of developer material across the length of the apparatus so that a sufficient supply of material is delivered to the magnetic brush over its full extent to develop the entire latent electrostatic image. It has been found that under certain conditions developer material tends to pump toward one end of the apparatus. Accordingly, insufficient material is delivered to areas of the magnetic brush to satisfactorily develop the entire latent electrostatic image creating copy defects such as voids or underdeveloped regions. Such conditions causing developer material pumping result from a variety of diverse parameters which include for example sump wall smoothness and developer material charge-to-mass ratio and toner concentration.

A type of ribbon blender has been described in commonly assigned U.S. Pat. Nos. 4,707,107, which issued to B. Joseph on Nov. 17, 1987, and 4,634,286, which issued to S. Pike on Jan. 6, 1987. This type ribbon blender consists of two concentric helical ribbons; the inner ribbon typically having the reverse pitch of the outer ribbon thereby inducing developer flow patterns conducive to mixing and tribocharging. The ribbons are normally attached to a common shaft and are thus rotated in the same direction.

Many variations of the ribbon configuration are possible. One configuration has the outer ribbon designed to transport material laterally toward the center of the station, and the inner ribbon configured to transport material laterally from the center toward the outside. Thus the inner and outer ribbons have reversed pitches on each half of the blender. If the direction of rotation is reversed, then the flow patterns also reverse. This configuration shows less sensitivity to flow imbalance since the blender is designed to slightly favor flow toward the center. Flow over the toning roller tends to reduce any center imbalance. The drawback of this configuration is that developer material must be removed from the center of the station when replacing developer. This necessitates removing developer stations from the machine when dumping or including a tray in the machine under the stations to catch developer as it's being dumped.

Another configuration of this type blender has the outer ribbon and inner ribbon of the same pitch the entire length of the blender. The inner and outer ribbon pitch are opposite each other. With this configuration developer material is transported laterally to one end of the station by the outer ribbon and back to the other end by the inner ribbon. The advantage of this configuration is that developer material can be dumped out the front of the station without removing the station from the machine if the outer ribbon is rotated to transport material to the front of the station. This configuration also provides a slight mixing advantage over a center balanced station since toner is brought into the station via the center ribbon the entire length of the station and must travel through the developer before reaching the toning roller. A drawback of this blender configuration is that flow balance sensitivity to material properties and hardware tolerances is increased. As a result, tighter manufacturing tolerances are required to achieve acceptable performance. If flow is not balanced, that is, if the outer ribbon doesn't transport the same amount of material at the same rate as the inner ribbon, then material will pile up at one end of the station resulting in nonuniform flow on the toning roller.

DISCLOSURE OF INVENTION

This invention is directed to an improved magnetic brush development apparatus for applying developer material to a latent electrostatic image wherein flow of developer material, distributed in balance across the length of the apparatus, is assured.

The mixing device described corrects for the shortcomings of the prior art by adjusting the pitch of the blender blades as a function of developer imbalance. As material builds up, the blade's pitch angle decreases reducing the rate it transports material toward areas of maximum build up. Thus, for a blender where the desired flow pattern is end-to-end, the end of the outer ribbon near the end of the station toward which material is transported by the outer ribbon is self adjusting. Similarly, the portion of the inner ribbon near the end of the station toward which material is transported by the inner ribbon. The end result is a mixing device that self balances. Material transport rates are adjusted automatically to achieve a balanced flow condition within the station.

According to a preferred embodiment of the present invention, an electrostatographic developer material mixing apparatus includes a ribbon blender having a drive member, a first flexible helical ribbon drivingly connected at one of its ends to the drive member for moving developer material along the length of the ribbon in a first direction, and a second flexible helical ribbon drivingly connected at one of its ends to the drive member for moving developer material along the length of the second ribbon in a direction opposite to the first direction. The end of each ribbon toward which developer material is moved is not connected to the drive member and is free to flex under load to change its pitch angle, whereby the rate of developer movement is reduced as developer material builds up at the ribbon ends.

According to another form of the preferred embodiment of the present invention, development apparatus having a sump for developer material, a ribbon blender for mixing developer material in the sump, and means for transporting developer material from the sump to a latent image on a receiver includes a ribbon blender having a rotatable shaft, first and second concentric helical ribbons oppositely coiled around the shaft with one ribbon having a larger diameter than the other; the smaller diameter ribbon being within the larger ribbon. Means are provided for supporting one end of each ribbon from the shaft so that rotation of the shaft effects rotation of the ribbons, whereby the developer material is moved by one ribbon in a first direction and by the other ribbon in a second direction opposite to the first direction. The other, unsupported ends of the ribbons are not connected to the shaft so as to be flexible, whereby the helical pitch angles of the ribbons are changeable to thereby reduce the rate of developer movement as developer builds up at the ribbon ends.

According to yet another form of the preferred embodiment of the present invention, the ribbon blender includes a rotatable shaft, a plurality of elements along the shaft, each element including first and second concentric helical ribbon sections oppositely coiled around the shaft with one ribbon section having a larger diameter than the other, the smaller diameter ribbon section being within the larger ribbon section. Means are provided for supporting at least one end of each ribbon section from the shaft so that rotation of the shaft effects rotation of the ribbon sections, whereby the developer material is moved by the larger ribbon section in a first direction and by the smaller ribbon section in a second direction opposite to said first direction. At least some of the ends of said ribbon sections are not connected to the shaft so as to be flexible, whereby the helical pitch angles of those ribbon sections are changable to thereby reduce the rate of developer movement as developer builds up at the ends of the ribbon blender.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
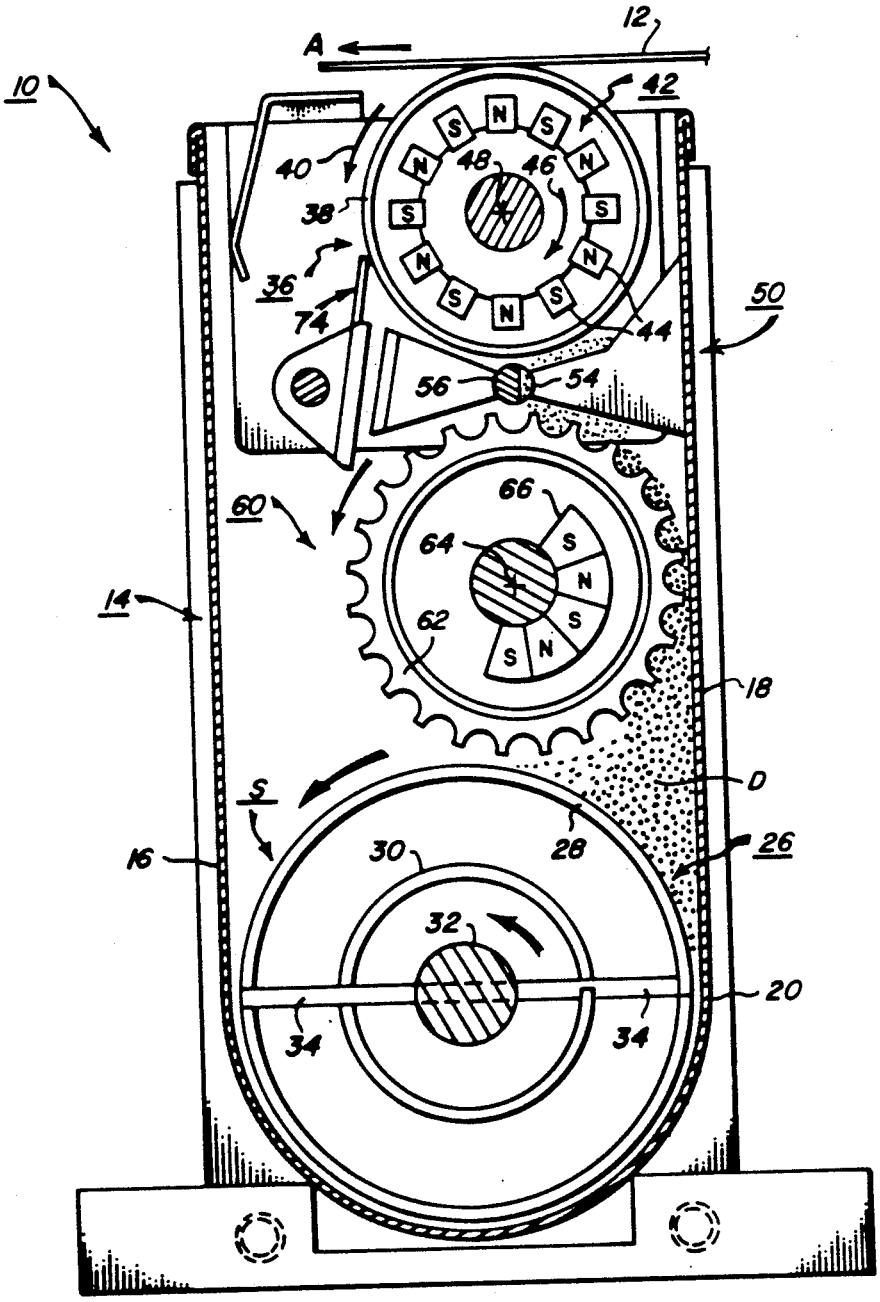
FIG. 1 is an end elevational view, partly in cross-section, of magnetic brush development apparatus of the present invention.

Referring now to the accompanying drawings, FIG. 1 shows a magnetic brush development apparatus according to this invention, generally designated by the numeral 10. Apparatus 10 is adapted to provide a supply of developer material, including pigmented marking particles, to an electrostatic latent image carried by a member 12 in order to develop the latent image on the member. Member 12, which is for example part of an electrostatographic reproduction apparatus, is in the form of an endless web or a drum, or can be discrete sheets on which a copy is formed. Member 12 is moved past apparatus 10 in the direction shown by the arrow during development of the latent image on the member.

Apparatus 10 comprises a housing 14 having spaced and generally parallel vertical side walls 16 and 18 and a generally semi-cylindrical bottom wall 20. The lower portion of the housing defines a sump S for containing a supply of developer material D. Developer material D can be of any known type, for example including two-component developer materials wherein the two-component developer materials have hard, permanent magnetic carrier particles and pigmented marking particles as disclosed in the afore-mentioned U.S. Pat. No. 4,546,060.

Figure 2:
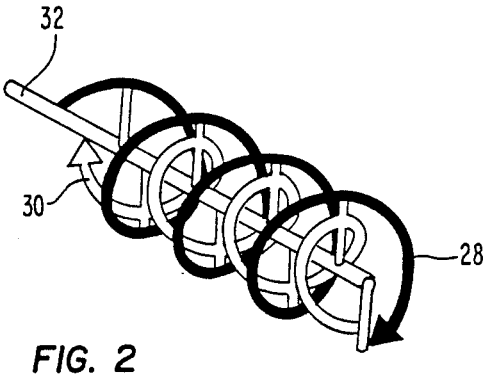
FIG. 2 is a schematic showing the flow pattern of the ribbon blender in the apparatus shown in FIG. 1.

Developer material D in sump S is agitated in order to provide triboelectric charging of the developer material, move the material along the length of the sump, and deliver developer material to a feed mechanism 60. Such agitation is effected by a ribbon blender generally designated by the numeral 26. Ribbon blender 26 comprises an outer helical ribbon 28 and an inner helical ribbon 30. Both ribbons are coiled concentrically about a shaft 32. Shaft 32 is, in turn, concentrically located with respect to the semi-cylindrical bottom wall 20 of housing 14, and runs for substantially the full length thereof. A plurality of rods 34 project from shaft 32. Ribbons 28 and 30 are attached to the rods so that the ribbons rotate with shaft 32. Ribbon 28 may have the same pitch throughout its length, or may have one pitch over half its length and the opposite pitch over the other half of its length. The pitch orientation of ribbon 30 is selected to be opposite to the pitch orientation of ribbon 28. When shaft 32 is rotated in a clockwise direction as viewed in FIG. 1, the ribbons drive developer material D in sump S in a direction from the front of housing 14 toward the rear, and then from the rear of the housing toward the front. This results in significant agitation and shearing of the developer material in order to triboelectrically charge the material. This action is schematically illustrated in FIG. 2.

A magnetic brush, generally designated by the numeral 36, is located at the top of housing 14. Magnetic brush 36 may be of any suitable construction, such as illustrated for example in FIG. 1 where the magnetic brush includes a shell 38 of a non-magnetic material that rotates counterclockwise as indicated by arrow 40 about a core 42. Core 42 comprises a plurality of permanent magnets 44 rotatable in a clockwise direction as shown by arrow 46. The axis of rotation of the core, coincident with the axis of rotation of the shell, is designated generally by the numeral 48. A portion of magnetic brush 36 projects through the top of housing 14 and lies directly underneath electrostatic latent image carrying member 12.

Immediately beneath magnetic brush 36 is a metering assembly 50 including an elongate, generally cylindrical feed slot 54 that extends substantially the full length of the magnetic brush and lie 36, such material being attracted to the outer surface of shell 38 by magnets 44 in the core of the magnetic brush. Flow of developer material D through slot 54 is controlled by a rod 56 having a D-shaped portion located within slot 54. The rod is mounted so that it can be selectively rotated about its axis to a position (shown in FIG. 1) where material D can flow through slot 54 to the magnetic brush 36, or to a position where slot 54 is substantially closed to prevent the passage of developer material to the magnetic brush.

Feed mechanism 60 is located between metering assembly 50 and ribbon blender 26. Feed mechanism 60 receives developer material D driven from the sump S by ribbon blender 26 and transports such material to metering assembly 50 and through slot 54 to magnetic brush 36. Feed mechanism 60 comprises a shell 62 rotatable in a counterclockwise direction about an axis designated by the numeral 64. Within shell 62 there are a plurality of stationary magnets 66 that extend about 160 degrees counterclockwise from a position generally directly above ribbon blender 26 to a position just ahead of feed slot 54. Developer material from the sump is attracted to shell 62 and held to the shell in the area under the influence of magnets 66. Thus the material can be transported from the sump to slot 54 without dropping from the shell.

In operation, developer material provided to magnetic brush 36 is used for developing an electrostatic latent image on image bearing member 12 in a development zone between the brush and the member. After development of the latent image, continued rotation of shell 38 of the magnetic brush brings the developer material remaining on the brush to a wiper that scrapes the material from the shell. The removed material returns by gravity to the sump S where it is mixed by ribbon blender 26 with developer material D remaining in the sump. Since material returned from the brush will be partially depleted of marking particles, fresh marking particles are periodically provided to the sump S by a marking particle replenishment mechanism, not shown.

As noted above, in prior magnetic brush development apparatus employing ribbon blenders there is a tendency under certain circumstances for the blender to pump developer material toward one end of the apparatus. The non-uniform distribution of developer material resulting from this pumping action causes insufficient material to be delivered to the full extent of the magnetic brush to satisfactorily develop an entire latent electrostatic image.

Figure 3:
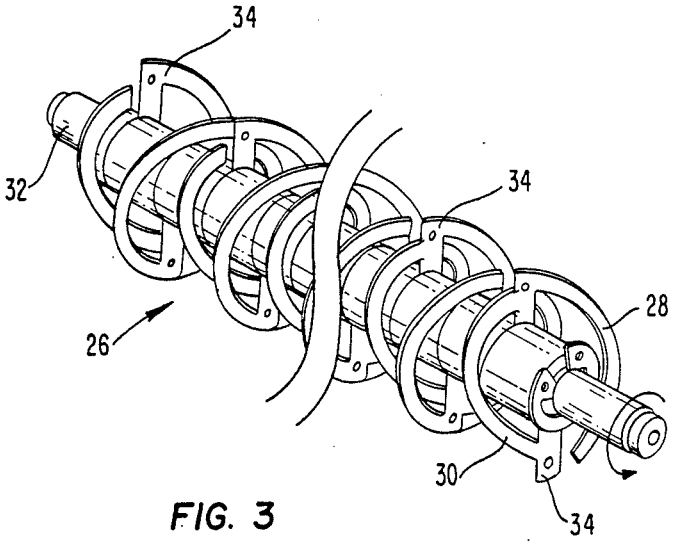
FIG. 3 is an enlarged view of the ribbon blender according to a preferred embodiment of the present invention.
Figure 4:
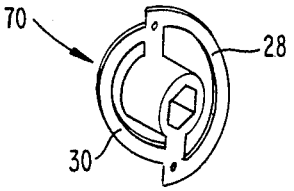
FIG. 4 is a view of one element of the ribbon blender of FIG. 3.

Referring to FIG. 3, ribbon blender 26 is preferably formed of a plurality of individual elements 70, one of which is illustrated in FIG. 4. Each element 70 contains two blades which form a portion of outer ribbon 28 and a portion of inner ribbon 30. The outer ribbon portion blades of the three individual elements nearest the right end of the blender as illustrated in FIG. 3 are modified such that one end of the ribbon portion is not connected to its associated rod 34. Similarly, the inner ribbon portion of the three individual elements nearest the left end of the blender are modified such that one end of the ribbon portion is not connected to its associated rod 24.

The ribbon is flexible, and the end of each ribbon (outer and inner) is not connected to the drive member so as to be free to flex under load to change its pitch angle. The pitch angle is a function of the force the developer material exerts on the blade, as well as the stiffness of the blade. As the developer load increases, the pitch angle will decrease, resulting in a reduction in the amount of developer material transported per revolution of the blender. As the developer load builds in either end of the development station, the load on the ribbon segments increases and the pitch angle of the blades pumping developer material toward that end decreases. As a result, the rate at which developer material is pumped toward that end also decreases. The net result is a mixing device that self balances and a balanced flow condition within the development station.

The invention has been described in detail with particular reference to preferred embodiments thereof, but it will be understood that variations and modifications can be effected within the spirit and scope of the invention. For example, ribbon blender 26 is illustrated as formed of several individual elements, but could be a single integral piece.

What is claimed is:

1. In an electrostatographic developer material mixing apparatus including a ribbon blender having:

a drive member;

a first flexible helical ribbon drivingly connected at one of its ends to the drive member for moving developer material along the length of the ribbon in a first direction;

a second flexible helical ribbon drivingly connected at one of its ends to the drive member for moving developer material along the length of the second ribbon in a direction opposite to said first direction;

the improvement wherein the end of each ribbon toward which developer material is moved is not connected to the drive member and is free to flex under load to change its pitch angle, whereby the rate of developer movement is reduced as developer material builds up at the ribbon ends.

2. The improvement defined as defined by claim 1 wherein the first ribbon is positioned inside the second ribbon.

3. The improvement as defined by claim 2 wherein the pitch of said first ribbon is opposite to the pitch of said second ribbon.

4. The improvement as defined by claim 1 wherein said mixing apparatus includes means for feeding developer material to a magnetic brush.

5. In development apparatus having (1) a sump for developer material comprising magnetic carrier particles and toner particles, (2) a ribbon blender for mixing developer material in the sump, and (3) means for transporting developer material from the sump to a latent image on a receiver, an improved ribbon blender comprising:

a rotatable shaft;

first and second concentric helical ribbons oppositely coiled around said shaft with one ribbon having a larger diameter than the other, the smaller diameter ribbon being within the larger ribbon; and means for supporting one end of each ribbon from the shaft so that rotation of the shaft effects rotation of the ribbons, whereby the developer material is moved by one ribbon in a first direction and by the other ribbon in a second direction opposite to said first direction;

the improvement wherein the other, unsupported ends of said ribbons are not connected to said shaft so as to be flexible, whereby the helical pitch angles of the ribbons are changable to thereby reduce the rate of developer movement as developer builds up at the ribbon ends.

6. In development apparatus having (1) a sump for developer material comprising magnetic carrier particles and toner particles, (2) a ribbon blender for mixing developer material in the sump, and (3) means for transporting developer material from the sump to a latent image on a receiver, an improved ribbon blender comprising:

a rotatable shaft;

a plurality of elements along said shaft, each element including first and second concentric helical ribbon sections oppositely coiled around said shaft with one ribbon section having a larger diameter than the other, the smaller diameter ribbon section being within the larger ribbon section;

means for supporting at least one end of each ribbon section from the shaft so that rotation of the shaft effects rotation of the ribbon sections, whereby the developer material is moved by the larger ribbon section in a first direction and by the smaller ribbon section in a second direction opposite to said first direction; and at least some of the ends of said ribbon sections are not connected to said shaft so as to be flexible, whereby the helical pitch angles of those ribbon sections are changable to thereby reduce the rate of developer movement as developer builds up at the ends of the ribbon blender.

7. The improved ribbon blender as defined in claim 6 wherein only those ribbon sections closest to the end of the ribbon blender toward which the ribbon sections move developer material are not connected to said shaft.

* * * * *